United States Patent [19]

Volkmar

[11] Patent Number: 4,621,175

[45] Date of Patent: Nov. 4, 1986

[54] DRIVE FOR A VACUUM SWITCH

[75] Inventor: Ralf R. Volkmar, Berlin, Fed. Rep. of Germany

[73] Assignee: Siemens Aktiengesellschaft, Berlin and Munich, Fed. Rep. of Germany

[21] Appl. No.: 720,410

[22] PCT Filed: Jul. 31, 1984

[86] PCT No.: PCT/DE84/00163

§ 371 Date: Mar. 28, 1985

§ 102(e) Date: Mar. 28, 1985

[87] PCT Pub. No.: WO85/00691

PCT Pub. Date: Feb. 14, 1985

[30] Foreign Application Priority Data

Aug. 1, 1983 [DE] Fed. Rep. of Germany ..... 3328183

[51] Int. Cl.[4] ..... H01H 33/66; H01H 3/46

[52] U.S. Cl. ..... 200/335; 200/144 B; 403/131; 403/76

[58] Field of Search ..... 200/335, 332, 144 B, 200/148 F; 403/76, 131

[56] References Cited

U.S. PATENT DOCUMENTS

| | | | |
|---|---|---|---|
| 1,875,575 | 9/1932 | Eckhard | 403/76 |
| 2,984,249 | 5/1961 | Sears, Jr. et al. | 403/76 |
| 3,214,550 | 10/1965 | Easley | 200/148 |
| 3,267,247 | 8/1966 | Ross | 200/168 |
| 3,501,180 | 3/1970 | Waara | 287/21 |

FOREIGN PATENT DOCUMENTS 2095476 9/1982 United Kingdom .

OTHER PUBLICATIONS

SACE publication, Bergamo, Italy, VRC Medium Voltage Vacuum Contactors, CAT 8-0/12-1980.

*Primary Examiner*—Stephen Marcus
*Assistant Examiner*—Renee S. Luebke
*Attorney, Agent, or Firm*—Kenyon & Kenyon

[57] ABSTRACT

A vacuum switch is provided with a drive lever (9) which may pivoted for switching on and switching off a vacuum switch tube. Between the drive lever (9) and the movable contact bolt (7) of the switch tube (1) there are provided a spherical bowl (13) and an adapted spherical hinged cavity (14), as well as a force transmission part (15). If the unit switch-on position is considered wherein the medial line (22) of the drive lever (9) is at right angle with respect to the longitudinal axis (23) of the movable contact bolt (7), the bowl central point (24) of the hinge device is shifted with respect to the medial line (22) of the drive lever (9) in the direction of the switch tube in a proportion corresponding to approximately half of the stroke of the movable contact bolt (7) during switch on and switch off. Thereby, the lateral displacement, more precisely the lateral forces exerted on the movable contact bolt (7) upon switching on and switching off are decreased down to a negligible value.

4 Claims, 7 Drawing Figures

DRIVE FOR A VACUUM SWITCH

TECHNICAL FIELD

The invention relates to a drive for a vacuum switch with joint parts arranged between its movable contact bolt and a drive lever which actuates the latter and is supported in a stationary manner for transmitting the actuating force to a switching tube; which are provided with central holes for the passage of the movable contact bolt of the switching tube and which have a spherical segment as well as a spherically shaped joint socket adapted thereto, where the center of the sphere of the segment is arranged offset in the direction of the switching tube from the center line of the drive lever extending at right angles to the axis of the contact bolt.

UNDERLYING STATE OF THE ART

A drive of this type has become known through a publication of the firm Sace, Bergamo, Italy with a designation CAT 8-0/12-1980. The parts of the joint make possible a relatively low-wear introduction of the actuating force from the drive lever to the movable contact bolt of the switching tube, where, however, transverse forces direction cross-wise to its longitudinal axis are exerted on the movable contact bolt. In order to insure proper functioning of this joint arrangement it is necessary to carefully align the movable contact bolt and the bore of the joint parts. To this end, the switching tube is pivoted at its fixed contact bolt likewise with joint parts in the manner of a ball joint.

With unfavorable tolerances between the fixed and the movable contact bolt, even additional transverse forces can be introduced into the movable contact bolt by the necessary alignment of the switching tube. In spite of the relatively high cost of two ball joints per switching tube, the occurrence of forces cannot be prevented which cause wear and shorten the service life of the vacuum switch.

A ball joint for fastening the switching tube of a vacuum switch to its stationary contact bolt is described in detail in British Pat. No. A2 095 476.

While it is known that switching tubes in vacuum switches can also be fastened rigidly (U.S. Pat. No. 3,267,247) and specifically in conjunction with a drive which comprises, similarly to the arrangement mentioned at the outset, a pivoted drive lever which is stationary and a body with a spherical working surface, this working surface interacts with a plane countersurface of the drive lever, where friction, wear and the occurrence of transverse forces between the driver lever and the movable contact bolt are unavoidable.

Starting from a vacuum switch of the type mentioned at the outset, it is an object of the invention to describe a drive in which the switching tube and its movable contact bolt as well as the drive lever operating the same are relieved of stresses by transverse forces during the switching motions, wherein the service life of the drive lever as well as of the switching tube is increased without expensive means.

DISCLOSURE OF THE INVENTION

According to the invention, this problem is solved by the provision that the distance of the center of the sphere from the center line of the drive lever corresponds approximately to one-half of the stroke of the contact bolt in switching on and off. With this position of the center of the sphere, the relative displacement between the drive lever and the movable contact bolt becomes a minimum of such small size that the offset can be neglected under practical conditions. This eliminates the necessity of a hinged or alignable fastening of the switching tube. It is merely necessary to see to it that the movable contact bolt and the drive lever are aligned with respect to each other free of forces in the rest position.

The distance of the center of the sphere from the center line can deviate from the exact value (one-half of the stroke of the movable contact bolt) within the usual tolerances. It can also be taken into consideration here that the stroke of the switching tubes can become somewhat larger in the course of their life.

The passage of the movable contact bolt without force through the joint arrangement can advantageously be achieved by the provision that the hole diameter of the joint parts amounts to about twice the bolt diameter and that a force-transmitting piece covering the hole diameter is provided for transverse alignment of the contact bolt relative to the joint parts in the force-free state. The switching tube can then be fastened rigidly with its fixed contact bolt to the frame of the switchgear. A tolerance occurring at this fastening point merely has the effect that the movable contact bolt does not go centered through the hole of the joint parts. This position of the parts obtained in the installation of the switching tube is preserved in switching on and off, so that no operational sliding motion occurs practically between the force-transmission piece and the parts of the joint.

The rigid fastening of the switching tube can advantageously be realized by providing the stationary contact bolt of the switching tube with an internal thread accessible from the end face and by providing it laterally with at least one flat, and a screw engaging the internal thread is fastened to a stationary connecting piece between cross-pieces rigidly and securely against rotation.

The invention will be explained in the following with the aid of the examples shown in the figures.

BEST WAY TO CARRY OUT THE INVENTION

Figure 1:
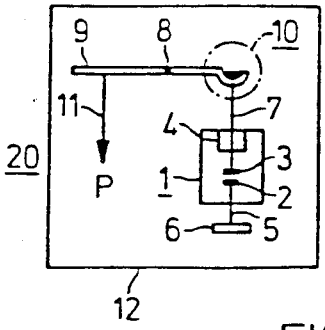
FIG. 1 shows schematically the vacuum switch according to the invention in a side view.

In FIG. 1, the drive of a vacuum switch 20 is shown schematically in a side view, all parts not required for an understanding of the invention, such as switching-on and -off springs, contact pressure generators and the like not being shown. The vacuum switch 20 contains a switching tube 1 with a fixed contact 2 and a movable contact 3 which is movable opposite the former and is sealed against the outside by means of bellows 4 consisting of metal and is guided movably. Switching tubes of this type are generally known and therefore require no detailed explanation in the context above. The switching tube 1 is rigidly fastened by means of the contact bolt 5 supporting the fixed contact 2 via a holding device 6.

The movable contact bolt 7 supporting the movable contact 3 is connected to a drive lever 9 which is supported fixed via a pivot 8, joint parts being arranged between the drive lever 9 and the contact bolt 7 for transmitting the actuating force, which are jointly designated with 11. For switching off the vacuum switch, the drive lever 9 is swung by a force P in the direction of the arrow 11. A frame or support 12 accepts the parts shown and in particular, determines the distance of the pivot 8 of the drive lever 9 from the holding device 6.

Figure 2:
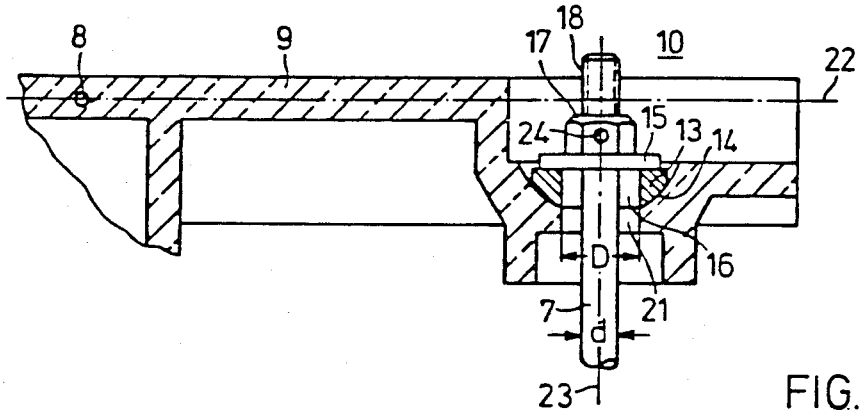
FIGS. 2 and 3 show a first embodiment of the joint parts arranged between a drive lever and a movable contact bolt in a cross-section, the joint socket being formed at the drive lever.
Figure 3:
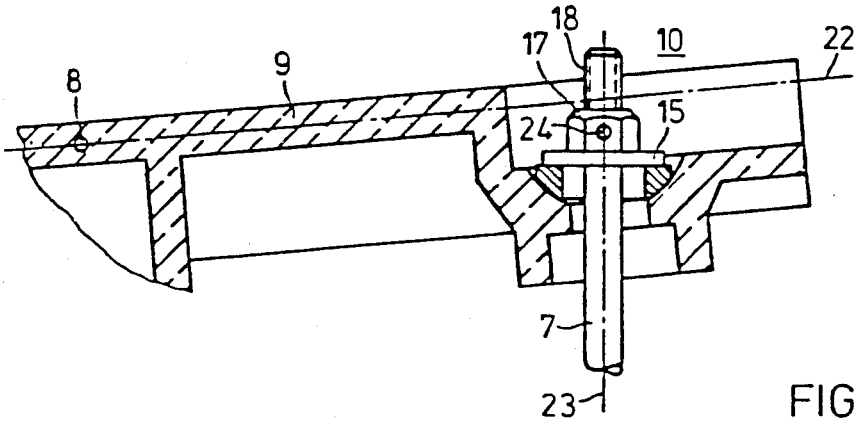

In FIGS. 2 and 3 the region of the joint parts 10 is shown magnified as a detail from FIG. 1.

The lever 9 consisting of insulating material is connected to the movable contact bolt 7 via the joint parts 10, among which are in particular a spherical segment 13 and a spherically-shaped joint socket 14. On the spherical segment 13 rests a disc-shaped force-transmitting piece 15 which covers the diameter D of a hole 16 going through the spherical segment 13. The force-transmitting piece 15 is braced against a nut 17 which is screwed on a thread 18 provided at the end of the movable contact bolt 7. The force-transmitting piece and the nut can also be made in one piece. The joint socket 14 is likewise provided with a centered opening 21 with a diameter D. The latter is approximately twice as large as the diameter d of the contact bolt 7.

As can be seen from FIG. 2 which shows the position of the drive lever 9 and the movable contact bolt 7 in the closed position of the vacuum switch according to FIG. 1, the center line 22 of the drive lever 9 which goes through the pivot 8 and is shown dash-dotted, and the likewise dash-dotted axis 23 of the movable contact bolt 7 are at right angles to each other. The center 24 of the sphere is located on the longitudinal axis 23 on the side of the center line 22 which is facing the switching tube which is not visible in FIGS. 2 and 3. The distance of the center 24 from the center line 22 is here about one-half the stroke of the contact bolt 7 which is traveled between the on position and the off position, an idle stroke of the drive lever 9 provided in practice for the force-free alignment of the contact bolt relative to the joint parts not being shown for simplification. The off position is shown in FIG. 3, in which otherwise the parts coinciding with FIG. 2 are provided with the same reference symbols.

As will be seen, only a purely axial displacement of the contact bolt 7 occurs in spite of the changed angular position of the drive lever 9. However, a displacement between the force-transmitting piece 15 and the spherical segment 13 does not come about. However, the case can occur that the longitudinal axis 23 of the movable contact bolt 7 goes through the borehole 16 of the spherical segment 13 or the borehole 21 of the joint socket 14 already in the starting position not centered but with a certain amount of displacement. This deviation can be caused by a tolerance at the mounting place of the switching tube within the switchgear. This relative position of the parts which comes about in the installation of the switchgear is preserved, however, when switching on and off, so that practically no transverse forces are exerted on the drive lever 9 and the contact bolt 7.

Figure 4:
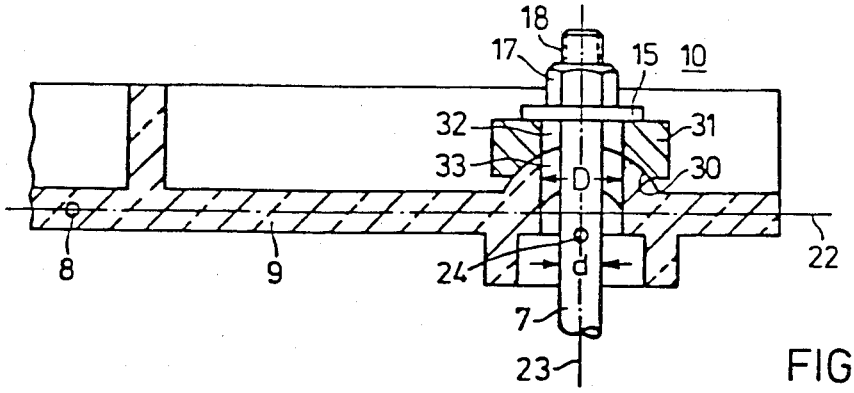
FIGS. 4 and 5 show, likewise in a cross-section, a further embodiment of the joint parts, the spherical segments being formed at the drive lever.
Figure 5:
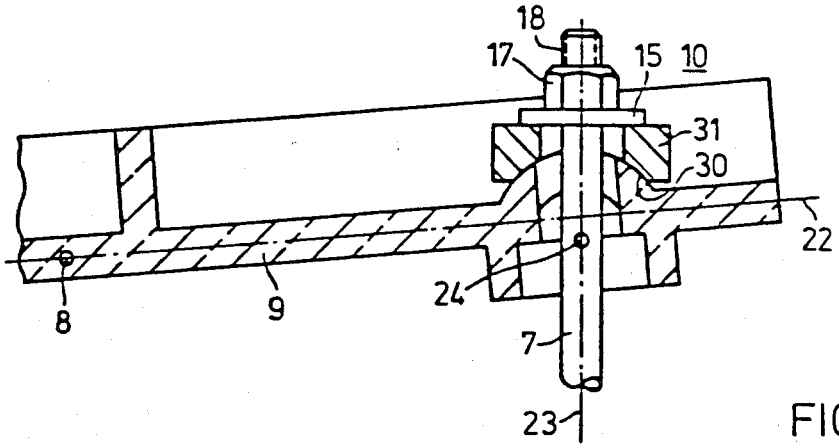

In the further embodiment according to FIGS. 4 and 5, the drive lever 9 is made differently from FIGS. 2 and 3 in such a manner that it does not contain the joint socket but is provided with a spherical segment 30. On the latter is placed a joint socket 31 which is provided with a borehole 32 for passing the movable contact bolt 7. As in the example explained before, the diameter D of the hole 32 as well as the diameter of the hole 33 going through the spherical segment 30 is about twice as large as the diameter d of the contact bolt 7. On the plane outside surface of the joint socket 31 rests a force-transmitting piece 15 which corresponds to FIGS. 2 and 3 and is braced via a nut 17 against the contact bolt 7. Again the position of the center 24 of the sphere on the side of the center line 22 of the drive lever 9 which is facing the switching tube, which is not visible in FIGS. 4 and 5 is essential. The distance from the intersection of the center line 32 and the longitudinal axis 23 of the contact bolt 7 is again about one-half of the stroke of the contact bolt 7 travelled during the closing and opening.

In the off position according to FIG. 5, the lever 9 is swung counterclockwise, but the longitudinal axis of the contact bolt 7 suffers no lateral displacement. The force-transmitting piece 15 therefore rests against the joint socket 31 in an unchanged position. Also in this embodiment, the force-transmitting piece and the nut can be made in one piece.

Figure 6:
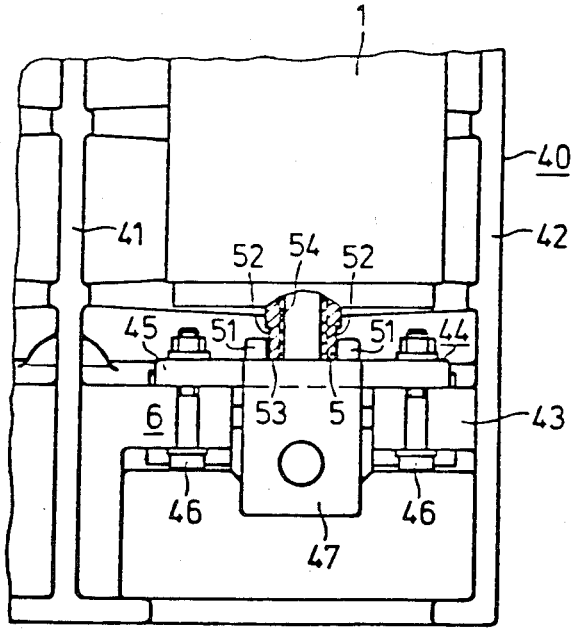
FIGS. 6 and 7 show an example for the rigid fastening of a switching tube with its stationary contact bolt in a front view and a partly cross-sectional side view.

As already mentioned, the described joint arrangement permits the switching tube 1 shown in FIG. 1 to be fastened rigidly to its stationary contact bolt 5. An example for such rigid fastening is shown in FIG. 6 in a front view and in FIG. 7 from the side, partially in cross-section.

In both figures, a support body consisting of insulating material is designated with 40. Side walls 41 and 42 as well as a bottom 43 delineate a space which is provided for receiving the switching tube 1 and is open to the front as shown in FIG. 6. On the bottom 43 rests a connecting angle 44 which comprises a mounting leg 45 and a clamping angle 47 arranged at right angles thereto. The mounting leg 45 is provided with holes for the passage of fastening screws 46 and a central holding screw 48. On both sides of the hole 50 provided for receiving the holding screw 48, the connecting angle 44 has ribs 51, between which the stationary connecting bolt 5 of the switching tube 1 is contained. The connecting bolt is advantageously provided on both sides with flats 52 in order to preclude the switching tube from getting twisted, and contains a tapped hole 54 accessible at the end face 53. The switching tube 1 rests with the plane end surface 53 of its connecting bolt 5 on the plane fastening leg 45 of the connecting angle 44. The holding screw 48 establishes the rigid mechanical connection between the switching tube and the connecting angle 44 and at the same time takes care of a low-loss current transfer between these parts. This kind of mounting the switching tube requires a considerably smaller effort that with the ball joints required heretofore, for instance as in British Pat. No. A-2,095,476 and makes at the same time sure that operating or external stresses, such as heating, switching forces and shocks remain without effect on the position of the switching tube within the switchgear.

Figure 7:
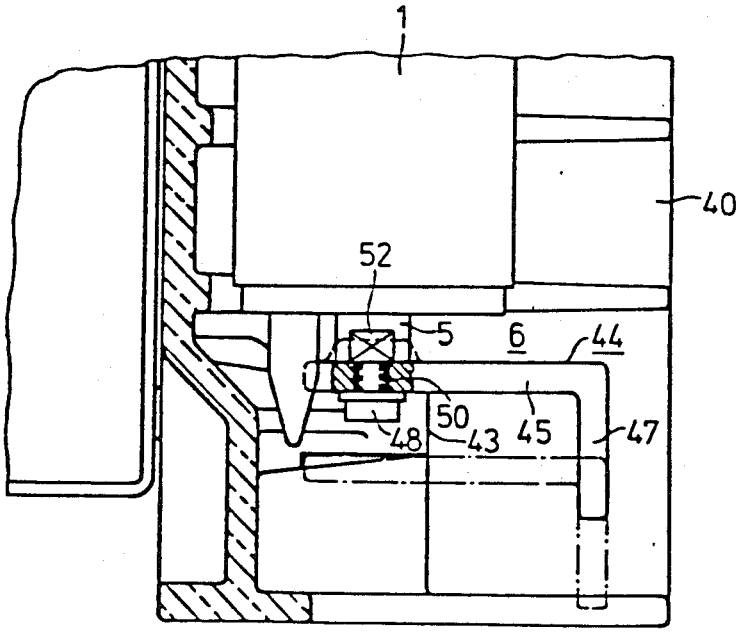

As can be seen, the connecting angle can be attached without any change of the parts also to the underside of the bottom 43, whereby the clamping angle 47 is given the position indicated dash-dotted in FIG. 7. It is then possible to use a switching tube of greater axial length and a spacer can be inserted for compensating different dimenions between the end face 53 and the mounting leg 45.

Commercial Applicability

The described joint arrangement is suitable particularly for vacuum switching equipment which should reach a very large number, i.e., over one million switching cycles without servicing. Such switching apparatus are, for instance, contactors for the voltage range of about 1 to 15 kV such as are used for switching on and off high-voltage motors and similar loads.

I claim:

1. A drive for a vacuum switch having joint means disposed between a movable contact bolt and a drive lever for operating the contact bolt, said joint means provided for the transmission of operating force to a switching tube, said joint means comprising a spherical segment and a spherically-shaped joint socket for receiving said segment, said segment and said socket being provided with centered holes for the passage of the movable contact bolt of the switching tube, the center of the spherical segment being disposed offset in the direction of the switching tube from a center line of the drive lever extending in the "on" position at right angles to an axis of the movable contact bolt, the distance of the center of the spherical segment from the center line of the drive lever corresponding approximately to one-half of the stroke of the movable contact bolt when switching between on and off, said vacuum switch further comprising a stationary contact bolt rigidly fastened to a base member.

2. The drive for a vacuum switch recited in claim 1, wherein the diameter of the centered holes is approximately twice the diameter of the movable contact bolt and further comprising a force-transmitting means covering the diameter of said holes for providing a transverse alignment of the movable contact bolt to said spherical segment and said socket in a force-free condition.

3. The drive for a vacuum switch recited in claim 1, wherein said switching tube comprises a stationary contact bolt, said stationary contact bolt having an internal thread accessible at an end face thereof and being provided laterally with at least one flat spot and being fastened by screw means engaging the internal thread to a stationary connecting means between ribs provided in said connecting means, whereby said switching tube is secured in a rigid manner against rotation.

4. A device for a vacuum switch having joint means disposed between a movable contact bolt and a drive lever for operating the contact bolt, said joint means provided for the transmission of operating force to a switching tube, said joint means comprising a spherical segment and a spherically-shaped joint socket for receiving said segment, said segment and said socket being provided with centered holes for the passage of the movable contact bolt of the switching tube, the center of the spherical segment being disposed offset in the direction of the switching tube from a center line of the drive lever extending in the "on" position at right angles to an axis of the movable contact bolt, the distance of the center of the spherical segment from the center line of the drive lever corresponding approximately to one-half of the stroke of the movable contact bolt when switching between on and off, said switching tube comprising a stationary contact bolt, said stationary contact bolt having an internal thread accessible at an end face thereof and being provided laterally with at least one flat spot and being fastened by screw means engaging the internal thread to a stationary connecting means between ribs provided in said connecting means, whereby said switching tube is secured in a rigid manner against rotation.

* * * * *